United States Patent [19]

Conley

[11] Patent Number: 4,554,773

[45] Date of Patent: Nov. 26, 1985

[54] DEVICE AND METHOD FOR SECURING OVERLAPPING CORRUGATED SHEETS

[76] Inventor: John L. Conley, 3870 Chino Ave., Chino, Calif. 91710

[21] Appl. No.: 605,295

[22] Filed: Apr. 30, 1984

[51] Int. Cl.[4] ..... E04B 1/74

[52] U.S. Cl. ..... 52/521; 52/63; 52/222; 52/506; 52/551; 52/747; 24/23 W; 24/703; 411/461; 411/466

[58] Field of Search ..... 52/459, 462, 461, 463, 52/741, 519, 747, 520, 521, 543, 548, 410, 551, 552, 63, 506, 509, 512, 222; 411/457, 461, 466; 24/23 W, 23 R, 36, 350–355, 703

[56] References Cited

U.S. PATENT DOCUMENTS

| | | | |
|---|---|---|---|
| 255,087 | 3/1882 | Sagendorph | 52/462 |
| 1,089,555 | 3/1914 | Hawksworth | 52/461 |
| 1,433,863 | 10/1922 | Williams | 52/552 X |
| 1,618,902 | 2/1927 | Yost | 52/551 |
| 1,755,538 | 4/1930 | Draughon, Jr. | 52/551 |
| 2,424,410 | 7/1947 | Miles | 52/543 X |
| 2,950,727 | 8/1960 | Dunn | 52/63 X |
| 3,798,710 | 3/1974 | Tinnerman | 52/506 X |
| 4,290,250 | 9/1981 | Kusenda | 52/506 X |

FOREIGN PATENT DOCUMENTS

| | | | |
|---|---|---|---|
| 753199 | 10/1934 | France | 411/466 |

*Primary Examiner*—Donald G. Kelly
*Assistant Examiner*—Richard E. Chilcot, Jr.
*Attorney, Agent, or Firm*—Boniard I. Brown

[57] ABSTRACT

A captive nut plate for engagement by a screw useful when attaching corrugated composite or plastic sheets together includes a semi-cylindrical body shaped to match the curvature of a corrugated sheet. A pair of upstanding irregular pentagon-shaped piercing prongs are centrally positioned along curved edges of the body and are aligned with a central hole therethrough, for receiving the screw. The captive nut plate is installed by positioning it in a convex pocket on a semi-cylindrical tool in proper alignment with a concave edge corrugation of a first sheet. A soft mallet is then used to drive the corrugated material down onto the nut plate so that the upstanding prongs pierce through the sheet. The irregular pentagon-shape of the prongs assures that the prongs extend through the sheet beyond their widest portion. The prongs are then peened over to provide a permanent installation on the first sheet. Once sufficient nut plates have been attached to the first sheet, the corrugated edge of a second sheet is placed over the edge of the first sheet and screws are driven through both sheets and torqued into the central holes in the nut plates to complete an overlapping joint.

17 Claims, 11 Drawing Figures

DEVICE AND METHOD FOR SECURING OVERLAPPING CORRUGATED SHEETS

BACKGROUND OF THE INVENTION

Of late, economical and lightweight greenhouses, pool coverings and other similar structure are constructed with corrugated composite or plastic sheets which have a high strength to weight ratio, a high transparency and a strong resistance to the elements. Normally, such sheets are constructed in long but relatively narrow extruded corrugated strips. The strips are cut in the desired length for a particular installation and then once installed on a framework, are lap joined together side-to-side to form an enclosure. Such lap joints have been formed using screws with elastomeric washers backed up by lap fasteners which must be held on one side of the panels by a first installer while the screw is inserted from the other side by a second installer. The economies of such structures are predicated on their ability to be erected quickly with little labor and the requirement for two workers to install the lap joint fasteners is a major installation expense which is heretofore been unavoidable.

BRIEF DESCRIPTION OF THE PRESENT INVENTION

The present invention is a captive fastener which preferably is installed in a concave edge corrugation of a corrugated sheet to provide purchase for a screw passing therethrough. In top view, the fastener has a body which is relatively rectangular but is in fact semi-cylindrical in shape, having two opposite linear edges and two opposite circular edges. Irregular pentagon prongs extend at right angles to the circular edge in alignment with a centrally located hole in the body for receiving a screw. When the prongs extend away from the convex side of the fastener, it is installed by placing it in a matching convex pocket formed in a semi-cylindrical tool. The concave surface of a corrugation is brought into matching alignment with the body surface and then using a soft mallet, the sheet is driven onto the fastener body so that the prongs are driven through the sheet down beyond their widest section formed by the irregular pentagon. This is important as plastic or composite sheets tend to shrink after piercing to firmly attach and lock the prongs to the sheet in much the same way an arrowhead locks into its target. The prongs are then peened over toward each other to assure further locking. Normally, the fasteners are positioned along a lapping edge prior to installation so that one worker can install all of the fasteners.

Once in the erected position, a second sheet is placed over the first sheet on the opposite side therefrom from the fastener so that when screws are driven through the two sheets from the opposite side, they can engage in the centrally located holes in the fasteners and thereby assure a tight joint.

Each irregular pentagon-shaped prong, mentioned above, is formed with a piercing point having an angle which preferably is less then 72°. Two corners adjacent the piercing point of the prong and at its widest portion each make an angle which when added to one half of the angle of the piercing point sum more than 180° so that two inwardly sloping sides are formed beneath the widest part of the prong to act as locking surfaces. Without these surfaces the twisting loads that are applied when the screw is inserted in the hole would tend to twist the prongs out of their pierced hole rather than urging them deeper as happens with the present invention due to the wedging action of the engaging sides.

Therefore it is a principal object of the present invention to provide a captive fastener useful in lap joining corrugated plastic or composite sheets, such as are used in greenhouses, pool covers and the like.

Another object is to provide a captive fastener for corrugated sheets which is economical to construct and whose use requires only one installer.

Another object is to provide a method for lap joining corrugated sheets with minimum labor.

Another object is to provide a method to decrease the construction cost of buildings constructed with corrugated sheets which must be lap joined at their side edges.

These and other objects and advantages of the present invention will become apparent to those skilled in the art after considering the following detailed specification together with the accompanying drawings wherein:

DETAILED DESCRIPTION OF THE SHOWN EMBODIMENT

Figure 1:
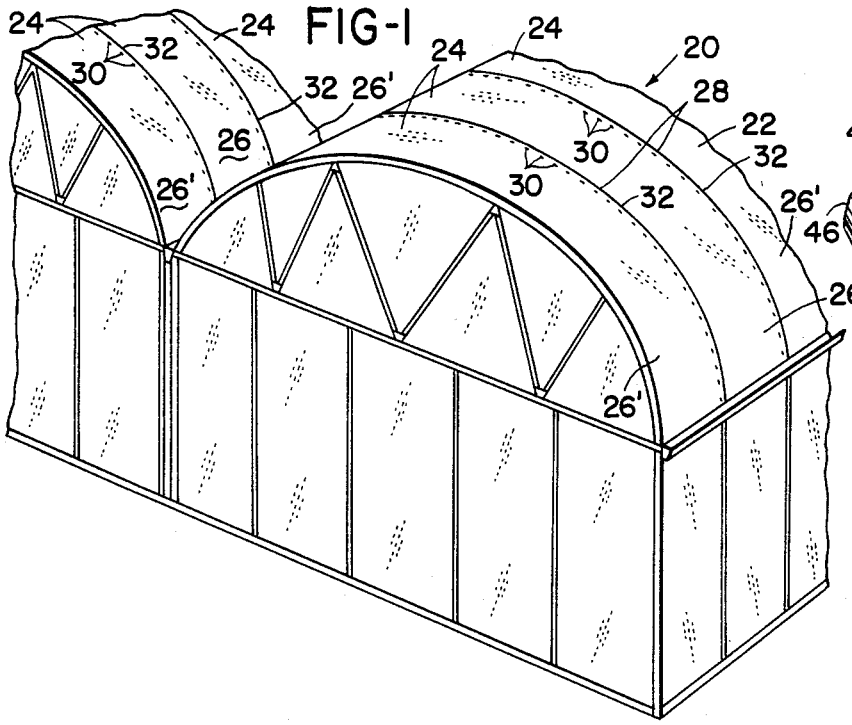
FIG. 1 is a perspective view of a portion of a typical greenhouse covered with corrugated composite sheets which are lap joined at their side edges.
Figure 2:
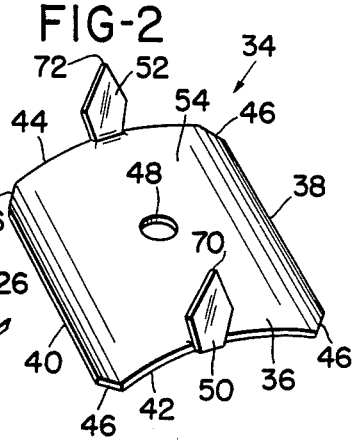
FIG. 2 is a perspective view of a preferred embodiment of the present invention, useful in forming the lap joints required in the construction of the greenhouse of FIG. 1.

Referring to the drawings more particularly by reference numbers, number 20 in FIG. 1 refers to a greenhouse whose roof 22 is constructed from a plurality of strips 24 constructed from corrugated composite sheets 26. Such roofs 22 are constructed with a plurality of lap joints 28 to form a unitary structure. These lap joints 28 are held together by screws 30 which extend through overlapping sheets 26 adjacent their edges 32 for engagement with captive fasteners 34 as shown in FIG. 2.

The captive fastener includes a semi-cylindrical body 36 having a generally rectangular plan-view shape with two opposite linear edges 38 and 40 and two opposite semicircular edges 42 and 44. The corners 46 between the edges 38, 42, 40 and 44 may be rounded or chamfered as shown to prevent the formation of a gauging or scratching edge which otherwise might occur.

A screw receiving hole 48 is positioned centrally within the body 36 for receiving a screw 30. The hole 48 is in alignment with two mounting prongs 50 and 52 which extend at right angles away from the convex surface 54 of the body 36 centrally from the edges 42 and 44 respectively.

Figure 3:
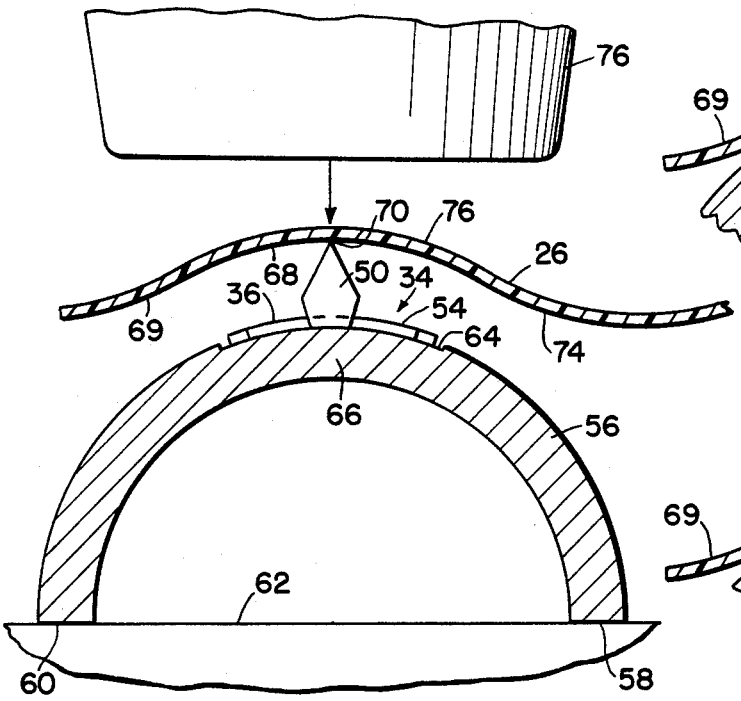
FIG. 3 is a side cross-sectional view showing the initiation of installation of the captive fastener of FIG. 2 on a corrugated plastic sheet.
Figure 4:
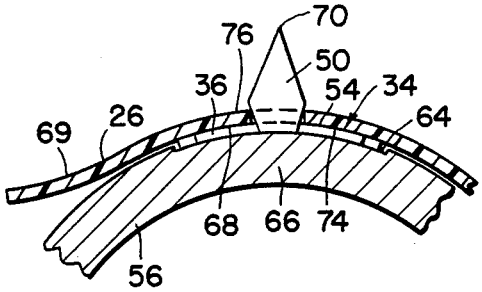
FIG. 4 is a cross-sectional view of the fastener and sheet shown in FIG. 3 with the prongs of the fastener pierced through the plastic sheet.
Figure 5:
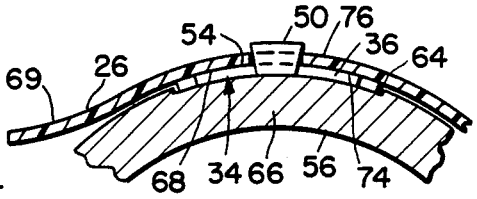
FIG. 5 shows the configuration of the fastener of FIGS. 2 through 4 when the installation thereof is completed with the prongs peened over.
Figure 6:
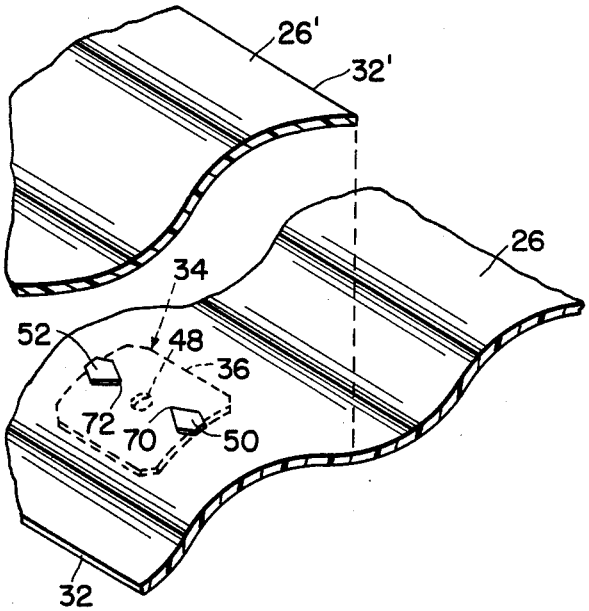
FIG. 6 is a perspective view of a lap joint being formed from two sheets utilizing the fastener of the present invention.
Figure 7:
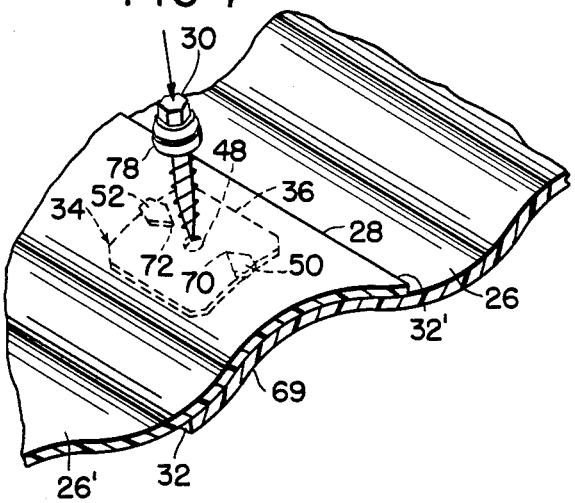
FIG. 7 shows the sheets of FIG. 6 lapped over one another with a screw being driven down through both sheets and into the fastener.
Figure 8:
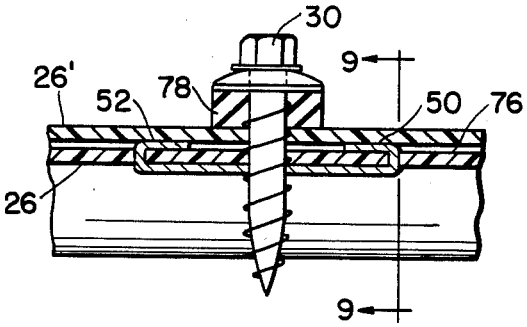
FIG. 8 is a longitudinal cross-sectional view through the completed assembly of FIG. 7.
Figure 9:
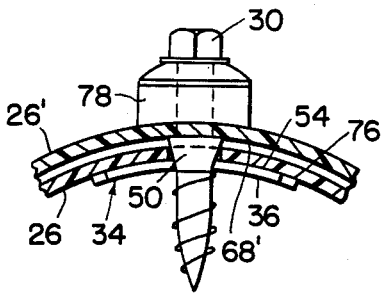
FIG. 9 is a transverse cross-sectional view along line 9—FIG. 8.

The captive fasteners 34 are installed in a sheet 26 as shown in FIGS. 3, 4 and 5. Normally a tool 56 having a semicircular cross-section is placed with its linear edge surfaces 58 and 60 on a hard support base 62. A convex pocket 64 shaped to receive the fastener 34 is formed at the apex 66 of the tool 56. The sheet 26 is positioned with a concave surface 68 near the edge 69 thereof in mating alignment with the convex surface 54 of the fastener 34 and with the points 70 and 72 of the prongs 50 and 52 respectively in engagement with the underside 74 thereof. A soft driving tool like a rubber mallet 76 is then used to drive the sheet 26 down into engagement with the convex surface 54 of the fastener body 36 so that the prongs 50 and 52 pierce the sheet 26 as shown in FIG. 4. Thereafter, the prongs 50 and 52 are peened over the convex surface 76 of the sheet 26 with the points 70 and 72 preferably pointing toward each other as shown in FIGS. 6 and 7. This assures that the fastener 34 will remain with the sheet 26 during subsequent handling and final positioning for joining with the corrugated edge 32' of an overlapping adjacent sheet 26' as shown. The edge 32' of the overlapping adjacent sheet 26' is positioned over the edge 69 of the sheet 26 so that the edge corrugations mate. Thereafter a screw 30 preferably having an elastomeric or other soft washer 78, is driven through the sheet 26' and the sheet 26, and into the hole 48 in the captive fastener 34. Twisting of the screw 30 draws it into the position shown in FIGS. 8 and 9 with the prongs 50 and 52 trapped between the concave surface 68' of the sheet 26' and the convex surface 76 of the sheet 26. Since the installation requires access to only one side of any sheet 26 at a time, the entire operation can be performed sequentially by a single workman in the same time it heretofore has taken two.

Figure 10:
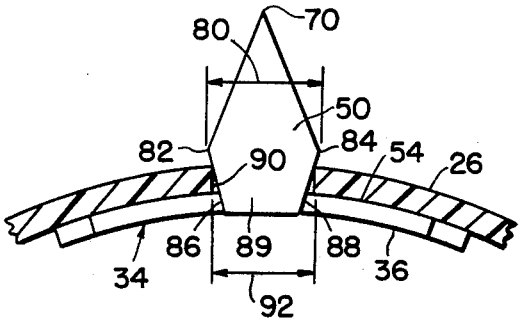
FIG. 10 is an enlarged cross-sectional view showing the relationship between a prong of the present fastener and the sheet through which it is driven prior to peening.
Figure 11:
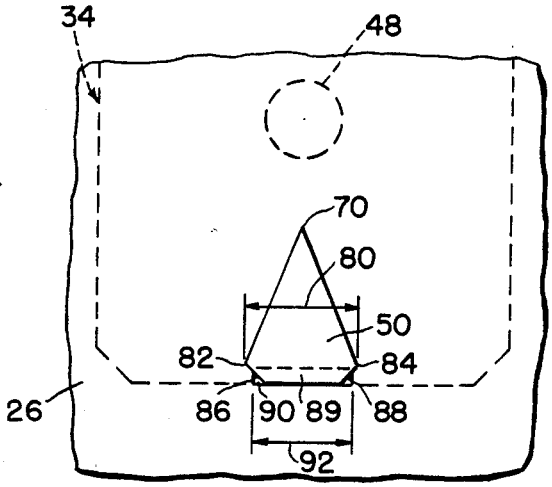
FIG. 11 is an enlarged, detail, top view of a prong after peening.

The shape of the prongs 50 and 52 is important to their operation. For example, as shown in FIGS. 10 and 11 prong 50 has an irregular pentagon-shape having a piercing point 70 substantially less than 72° while the widest portion 80 of the prong 50 is formed by corners 82 and 84 substantially greater than 72°. The result is two edges 86 and 88 which slope toward each other as they extend toward and are attached to the body 36 at a narrower portion 89. Since plastic and composite sheets tend to recover after being priced, the hole 90 formed by the prong 50 when driven through the sheet 26 has a width 92 which tends to be substantially narrower than the prong shoulder 80 to aid in retention. This also can be seen in FIG. 11 where in the prong 50 has been bent over. The only forces tending to remove the captive fastener 34 are twisting forces caused by installation of the screw 30 by having the shoulder 80 wider in an area which is passed through the sheet 26, the twisting motion tends to drive the prong 50 further into the sheet 26 rather than force it outwardly as would be the case without the inwardly sloping edges 86 and 88.

Thus there has been shown and described a novel captive fastener and method of construction which fulfills all of the objects and advantages sought therefor. Many changes, alterations, modifications and other uses and applications of the subject fastener and method will become apparent to those skilled in the art after considering this specification together with the accompanying drawings. All such changes, alterations and modifications which do not depart from the spirit and scope of the invention are deemed to be covered by the invention which is limited only by the claims which follow.

What is claimed is:

1. Fastening means for joining the edges of corrugated sheets together, said means include:

a fastener plate having:

an arcuate body with:

a first edge;

a second opposite edge; and a screw receiving orifice positioned between said first and second edges; and first and second prongs extending at right angles to said arcuate body from said first and second edges respectively, each prong having:

a piercing point extending away from said arcuate body;

a central portion; and a connecting portion attaching said central portion to said edge, said connecting portion being narrower than said central portion.

2. The fastening means for joining the edges of corrugated sheets together as defined in claim 1 wherein said said first and second edges of said arcuate body are arcuate edges, said arcuate body also including:

a third linear edge generally at right angles to said first and second edges; and a fourth linear edge opposite said third edge generally at right angles to said first and second edges and parallel to said third edge.

3. The fastening means for joining the edges of corrugated sheets together as defined in claim 1 wherein said first and second prongs are irregular pentagons in shape and are aligned with said screw receiving orifice.

4. The fastening means for joining the edges of corrugated sheets together as defined in claim 3 wherein each of said piercing points is formed with an angle of less than 72°.

5. The fastening means for joining the edges of corrugated sheets together as defined in claim 4 wherein each of said central portions includes a pair of opposite corners, each being formed with an angle of greater than 72°.

6. The fastening means for joining the edges of corrugated sheets together as defined in claim 4 wherein each of said central portions includes a pair of opposite corners, each being formed with an angle which when added to one half of said angle of said piercing point equals more than 180°.

7. The fastening means for joining the edges of corrugated sheets together as defined in claim 2 further including:

a screw for engagement in said screw receiving orifice; and a relatively soft washer mounted on said screw.

8. The fastening means for joining the edges of corrugated sheets together as defined in claim 7 further including:

a semi-cylindrical tool having:
first and second leg surfaces for supporting said tool;
an apex equidistant between said first and second leg surfaces; and
a convex fastener plate receiving pocket formed at said apex for holding said fastener plate as it is being installed on a corrugated sheet.

9. Fastening means including:
a first corrugated sheet having:
an edge portion with:
a convex side; and
a concave side;
a fastener plate having:
an arcuate body with:
a convex, generally cylindrical surface shaped to mate with said concave side of said first corrugated sheet edge portion;
a first edge;
a second opposite edge; and
a screw receiving orifice positioned between said first and second edges; and
first and second prongs connected to said first and second edges respectively of said arcuate body and extending through said concave surface and said convex surface of said first corrugated sheet edge portion, each prong having:
a piercing point portion;
a central portion; and
a connecting portion attaching said central portion to said edge, said connecting portion being narrower than said central portion, said central portion and said piercing point portion being bent into engagement with said convex surface of said first corrugated sheet edge portion.

10. The fastening means as defined in claim 9 wherein said each of said piercing point portions is formed with an angle of less than 72° and wherein each of said central portions includes a pair of opposite corners, each being formed with an angle of greater than 72°.

11. The fastening means as defined in claim 10 further including:
a second corrugated sheet having:
an edge portion with:
a convex side; and
a concave side, said concave side of said second corrugated sheet edge portion being positioned in contact with said convex side of said first corrugated sheet edge portion;
a screw extending through said first and second corrugated sheets into engagement in said screw receiving orifice.

12. The fastening means as defined in claim 11 further including:
a relatively soft washer mounted on said screw in contact with said concave side of said second corrugated sheet edge portion.

13. The fastening means as defined in claim 12 further including:
a semi-cylindrical tool having:
first and second leg surfaces for supporting said tool;
an apex equidistant between said first and second leg surfaces; and
a convex fastener plate receiving pocket formed at said apex for holding said fastener plate as it is being installed on said first corrugated sheet.

14. A method of forming an overlapping joint at the edges of first and second corrugated sheets each having an edge portion with a convex side, and a concave side including the steps of:
positioning a screw plate having an arcuate body with a convex, generally cylindrical surface shaped to mate with said concave side of the first corrugated sheet edge portion a first edge, a second opposite edge, and a screw receiving orifice positioned between the first and second edges, and first and second prongs connected to the first and second edges respectively of the arcuate body and extending through the concave side and the convex side of the first corrugated sheet edge portion, each prong having a piercing point portion, a central portion, and a connecting portion narrower than the central portion, the central portion and the piercing point portion being bent into engagement with the convex side of the first corrugated sheet edge portion with the piercing points in contact with the concave side of the first corrugated sheet edge portion;
driving the piercing point portion and the central portion of each prong through the first corrugated sheet;
bending the piercing point portion and the central portion of each prong into contact with the convex side of the first corrugated sheet edge portion;
placing the concave side of the second corrugated sheet edge portion into contact with the convex side of the first corrugated sheet edge portion;
driving a screw through the second corrugated sheet edge portion;
driving the screw through the first corrugated sheet edge portion; and
engaging the screw with the screw receiving orifice.

15. The method of forming an overlapping joint as defined in claim 14 wherein said step of bending the piercing point portion and the central portion of each prong into contact with the convex side of the first corrugated sheet edge portion includes:
bending the piercing point portions toward each other.

16. The method of forming an overlapping joint as defined in claim 15 wherein said step of driving the piercing point portion and the central portion of each prong through the first corrugated sheet includes:
supporting the screw plate; and
pushing the first corrugated sheet into the prongs.

17. The method of forming an overlapping joint as defined in claim 15 including the step of:
placing a soft washer on the screw prior to the step of driving the screw through the second corrugated sheet edge portion.

* * * * *